US006332783B1

(12) United States Patent
Ukiya et al.

(10) Patent No.: US 6,332,783 B1
(45) Date of Patent: Dec. 25, 2001

(54) CIRCUIT MODULE HAVING CONNECTORS, AND ELECTRONIC APPARATUS INCORPORATING THE CIRCUIT MODULE

(75) Inventors: Yoshiaki Ukiya, Ome; Shizuo Morioka, Hanno, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/450,220

(22) Filed: Nov. 29, 1999

(30) Foreign Application Priority Data

Nov. 30, 1998 (JP) ..... 10-340059

(51) Int. Cl.[7] ..... H01R 12/00
(52) U.S. Cl. ..... 439/76.1; 439/79
(58) Field of Search ..... 439/76.1, 79, 80, 439/660, 677

(56) References Cited

U.S. PATENT DOCUMENTS 4,767,342 * 8/1988 Sato ..... 439/80
5,079,671 * 1/1992 Garrett et al. ..... 439/79
5,281,165 * 1/1994 McCleerey et al. ..... 439/79
5,299,942 * 4/1994 Burke et al. ..... 439/79
5,329,428 * 7/1994 Block et al. ..... 439/74
5,549,480 * 8/1996 Cheng ..... 439/79

OTHER PUBLICATIONS

English language abstract of Japanese Patent Publication No. 09–154287 dated Jun. 10, 1997.

* cited by examiner

*Primary Examiner*—Tulsidas Patel
(74) *Attorney, Agent, or Firm*—Finnegan, Henderson, Farabow, Garrett & Dunner, L.L.P.

(57) ABSTRACT

A circuit module comprising a circuit board, a high-voltage element electrically connected to the circuit board, and an electrically insulting cover covering the high-voltage element. The high-voltage element has a first output terminal for outputting a reference voltage and a second output terminal for outputting a voltage higher than the reference voltage. The cover includes a connector section. The connector section has a first connection terminal, a second connection terminal, and a partition. The first connection terminal is electrically connected to the first output terminal, and the second connection terminal is electrically connected to the second output terminal. The first and second connection terminals are spaced apart. The partition is provided between the first and second connection terminals, isolating the connection terminals from each other.

21 Claims, 8 Drawing Sheets

CIRCUIT MODULE HAVING CONNECTORS, AND ELECTRONIC APPARATUS INCORPORATING THE CIRCUIT MODULE

BACKGROUND OF THE INVENTION

The present invention relates to a circuit module having a high-voltage element and a connector connected to the high-voltage element, and also to an electronic apparatus, such as a portable computer, which incorporates the circuit module.

Portable electronic apparatuses, typified by portable computers, comprises a main body and a display unit. The display unit is supported by the main body. The display unit comprises a box-shaped housing, a flat liquid crystal display, and an FL inverter. The housing has an opening in the front. Both the display and the FL inverter are provided in the housing. The liquid crystal display has a screen to displaying information, such as characters and images. The screen is exposed outside through the opening of the housing. The FL inverter is designed to drive the back light incorporated in the liquid crystal display. The FL inverter is an elongate component, which extends horizontally in the lower part of the housing or vertically in the left or right part of the housing. The FL inverter is electrically connected to the back light by a cable. The cable has a cable connector at its distal end.

Recently it is increasingly demanded that portable computers be thinner and lighter. It is also demanded that portable computer have a large, high-resolution screen for displaying information that is easy to perceive visually. The larger the screen, the larger the liquid crystal display. The display will occupy almost all inner space of the housing unless the size of the housing of the display unit is proportionally increased. No space will be hardly provided to accommodate the FL inverter. If so, it is necessary to make the FL inverter more slender and more compact.

A conventional FL inverter of ordinary type is a circuit module. It comprises an elongate circuit board and various circuit components mounted on the circuit board. Among the circuit components are a transformer and a connector. The transformer and the connector are arranged on one end section of the circuit board. The transformer has a first output terminal for outputting a reference voltage and a second output terminal for outputting a voltage higher than the reference voltage. The connector has a first connection terminal and a second connection terminal. The first and second connection terminals extend parallel and are spaced part. The cable connector provided at the distal end of the above-mentioned cable is removably connected to both connection terminals of the connector.

The circuit board has a pair of wiring patterns. The wiring patterns are located between the transformer and the connector. They extend parallel and spaced apart from each other. The first writing pattern has a first end soldered to the first output terminal, and a second end soldered to the first connection terminal. The second writing pattern has a first end soldered to the second output terminal, and a second end soldered to the second connection terminal. Thus, the wiring patterns electrically connect the connector to the transformer.

In the FL inverter thus structured, a high voltage is applied to the second wiring pattern that is connected to the second output terminal. The wiring patterns must be spaced apart sufficiently in order to prevent discharge between them. The width of the circuit board is inevitably large. Consequently, the FL inverter cannot be so slender or compact as is recently demanded.

Hitherto, a slit is made in that part of the circuit board which lies between the wiring patterns, thereby to prevent discharge between the wiring patterns. The slit is less wide than the distance by which the wiring patterns should be spaced apart to prevent discharge. Hence, the wiring patterns can be positioned closer to each other than in the case where the circuit board has no slits, and the circuit board can be made narrow and compact.

However, the circuit board cannot have a sufficient strength since the slit extends along the entire length of both wiring patterns. If the circuit board is pushed while being secured to the housing of the display unit, it may be bent at the part having the slit. If the circuit board is bent, the solder junctions of the wiring patterns and the output terminals and connection terminals may have cracks, or the output terminals and connection terminals may peel off the wiring patterns. In either case, the electrical connection between each wiring pattern and the terminals will be impaired. Hence, much cares must be taken to secure the to the housing of the display unit.

In the conventional FL inverter, the wiring patterns mounted on the circuit board are exposed. It is therefore necessary to attach an insulator made of synthetic resin to the circuit board after soldering the transformer and the connectors to the board, thereby to cover all exposed parts of the wiring patterns, including the sides of the patterns. Inevitably, the number of steps of assembling the FL inverter will increase.

BRIEF SUMMARY OF THE INVENTION

The first object of the present invention is to provide a compact circuit module which comprises a circuit board having a small width and yet having a sufficient strength and which has no insulator whatever.

The second object of the invention is to provide an electronic apparatus which comprises a housing and a circuit module that is compact enough to be incorporated into the housing with ease.

To achieve the first object of the invention, there is provided a circuit module which comprises: a circuit board; a high-voltage element electrically connected to the circuit board and having a first output terminal for outputting a reference voltage and a second output terminal for outputting a voltage higher than the reference voltage; and an electrically insulating cover covering the high-voltage element. The cover includes a connector section, which has a first connection terminal electrically connected to the first output terminal, a second connection terminal electrically connected to the second output terminal and spaced apart from the first connection terminal, and a partition provided between the first connection terminal and the second connection terminal and isolating the connection terminals from each other.

The partition of the cover isolates the first connection terminal to which a reference voltage is applied, from the second connection terminal to which a higher voltage is applied. The first and second connection terminals can therefore be arranged closer than otherwise. In other words, a large space need not be provided between the first and second connection terminals. Hence, the cover including the connector section can be as narrow as is desired.

Since the partition electrically insulates the first and second connection terminals, no slits need to be made in the circuit board. The circuit board is therefore strong enough not to be bent or deformed. Hence, the electrical connection between the high-voltage element and the connection terminals is sufficiently reliable.

In addition, the connector section of the cover completely covers the high-voltage element and both connection. An insulator need not be used to cover the second connection terminal to which a high voltage is applied. This reduces the number of the components constituting the circuit module and simplifies the method of manufacturing the circuit module.

To achieve the first object of the invention, there is provided a circuit module which comprises: a circuit board; a high-voltage element electrically connected to the circuit board and having a first output terminal for outputting a reference voltage and a second output terminal for outputting a voltage higher than the reference voltage; and an electrically insulating cover covering the high-voltage element and including a connector section. The connector section has a first connection terminal and a second connector terminal. The first connection terminal is electrically connected to the first output terminal, and the second connection terminal is electrically connected to the second output terminal. The connector section covers at least the second connection terminal and a junction between the second connection terminal and the second output terminal.

In this circuit module, the connector section of the cover isolates the first connection terminal from the second connection terminal. The first and second connection terminals can therefore be arranged closer than otherwise. In other words, a large space need not be provided between the first and second connection terminals. Thus, the cover including the connector section can be as narrow as is desired.

The connector section electrically insulates the first and second connection terminals, and no slits need to be made in the circuit board. The circuit board is strong enough not to be bent or deformed. The electrical connection between the high-voltage element and the connection terminals is therefore sufficiently reliable.

In addition, the connector section of the cover completely covers the high-voltage element and both connection. An insulator need not be used to cover the second connection terminal to which a high voltage is applied. This reduces the number of the components constituting the circuit module and simplifies the method of manufacturing the circuit module.

To attain the first object of the invention, too, there is provided a circuit module comprises: a circuit board; a high-voltage element mounted on the circuit board and having a first output terminal for outputting a reference voltage and a second output terminal for outputting a voltage higher than the reference voltage; and an electrically insulating cover comprising a first cover section covering the high-voltage element and a second cover section. The second cover section has a first connection terminal electrically connected to the first output terminal, a second connection terminal electrically connected to the second output terminal and spaced apart from the first connection terminal, and a partition provided between the first connection terminal and the second connection terminal and isolating the connection terminals from each other.

In this circuit module, the connector section of the cover isolates the first connection terminal from the second connection terminal. The first and second connection terminals can therefore be arranged closer than otherwise. In other words, a large space need not be provided between the first and second connection terminals. Thus, the cover including the connector section can be as narrow as is desired.

The connector section electrically insulates the first and second connection terminals, and no slits need to be made in the circuit board. The circuit board is strong enough not to be bent or deformed. The electrical connection between the high-voltage element and the connection terminals is therefore sufficiently reliable.

Further, since the cover completely covers the second connection terminal, an insulator need not be used to cover the second connection terminal to which a high voltage is applied. This reduces the number of the components constituting the circuit module and helps to simplify the method of manufacturing the circuit module.

To achieve the second object of this invention, there is provided a electronic apparatus comprises: a housing, and a circuit module provided in the housing. The circuit module comprises: a circuit board supported in the housing; a high-voltage element mounted on the circuit board and having a first output terminal for outputting a reference voltage and a second output terminal for outputting a voltage higher than the reference voltage; and an electrically insulating cover covering the high-voltage element and including a connector section. The connector section has a first connection terminal electrically connected to the first output terminal; a second connection terminal electrically connected to the second output terminal and spaced apart from the first connection terminal, and a partition provided between the first connection terminal and the second connection terminal and isolating the connection terminals from each other.

In the electronic apparatus, the partition of the cover isolates the first connection terminal from the second connection terminal. The first and second connection terminals can therefore be arranged closer than otherwise. In other words, a large space need not be provided between the first and second connection terminals. Thus, the circuit board and the cover can be as narrow and compact as is desired. As a result, the circuit module can be compact enough to be incorporated into the housing with ease, even if the housing is relatively small.

To attain the second object of the invention, there is provided a electronic apparatus comprises a housing and a circuit module provided in the housing. The circuit module comprises: a circuit board supported in the housing; a high-voltage element electrically connected to the circuit board and having a first output terminal for outputting a reference voltage and a second output terminal for outputting a voltage higher than the reference voltage; and an electrically insulating cover covering the high-voltage element and including a connector section. The connector section has a first connection terminal electrically connected to the first output terminal, and a second connection terminal electrically connected to the second output terminal. The connector section covers at least the second connection terminal and a junction between the second connection terminal and the second output terminal.

In this electronic apparatus, the connector section of the cover isolates the first connection terminal from the second connection terminal. The first and second connection terminals can therefore be arranged closer than otherwise. In other words, a large space need not be provided between the first and second connection terminals. Thus, the circuit board and the cover can be as narrow and compact as is desired. As a result, the circuit module can be compact enough to be incorporated into the housing with ease, even if the housing is relatively small.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A portable computer, which is the first embodiment of this invention, will be described, with reference to FIGS. 1 to 7.

Figure 1:
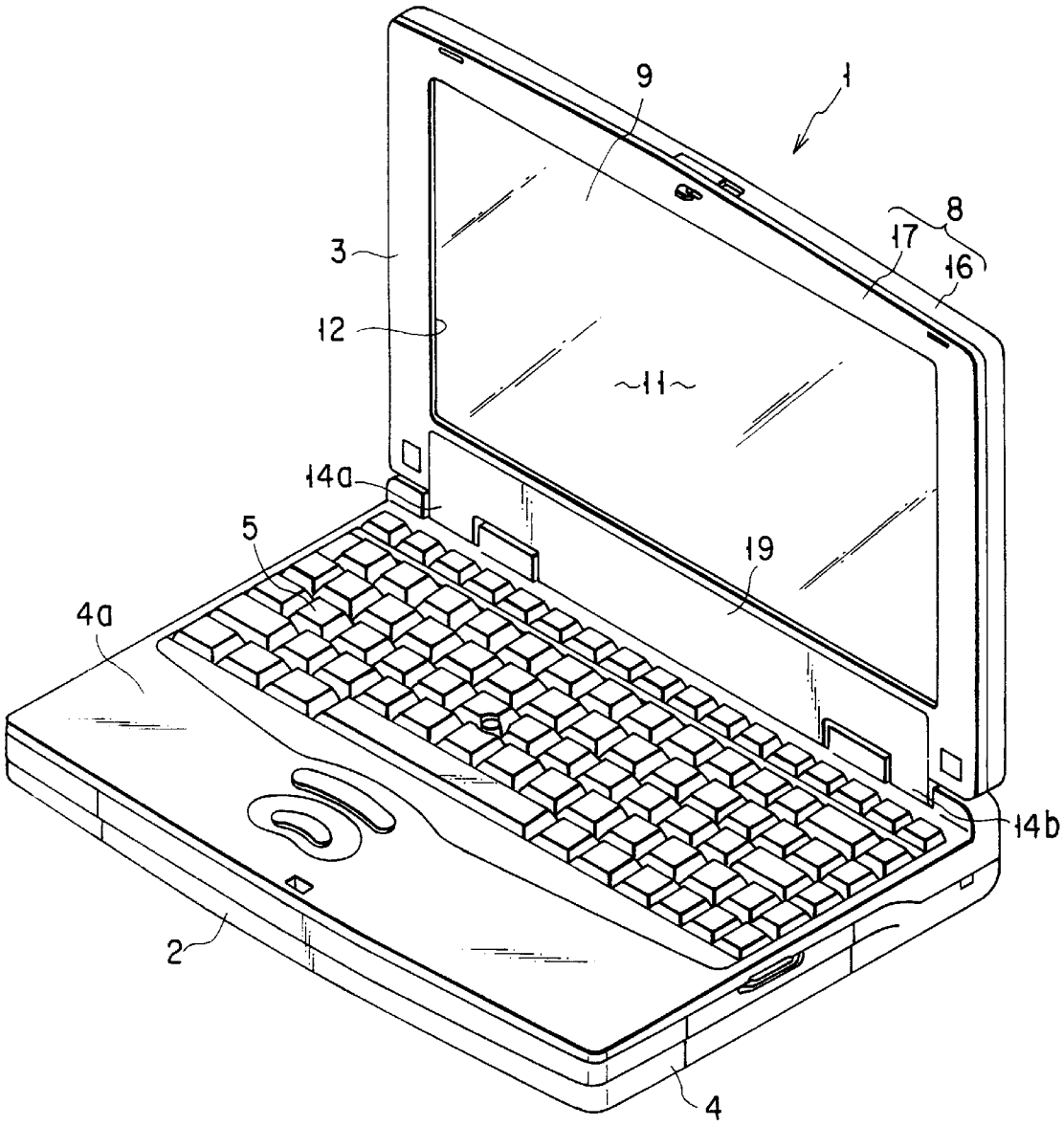
FIG. 1 is a perspective view of a portable computer which is the first embodiment of the present invention.
Figure 2:
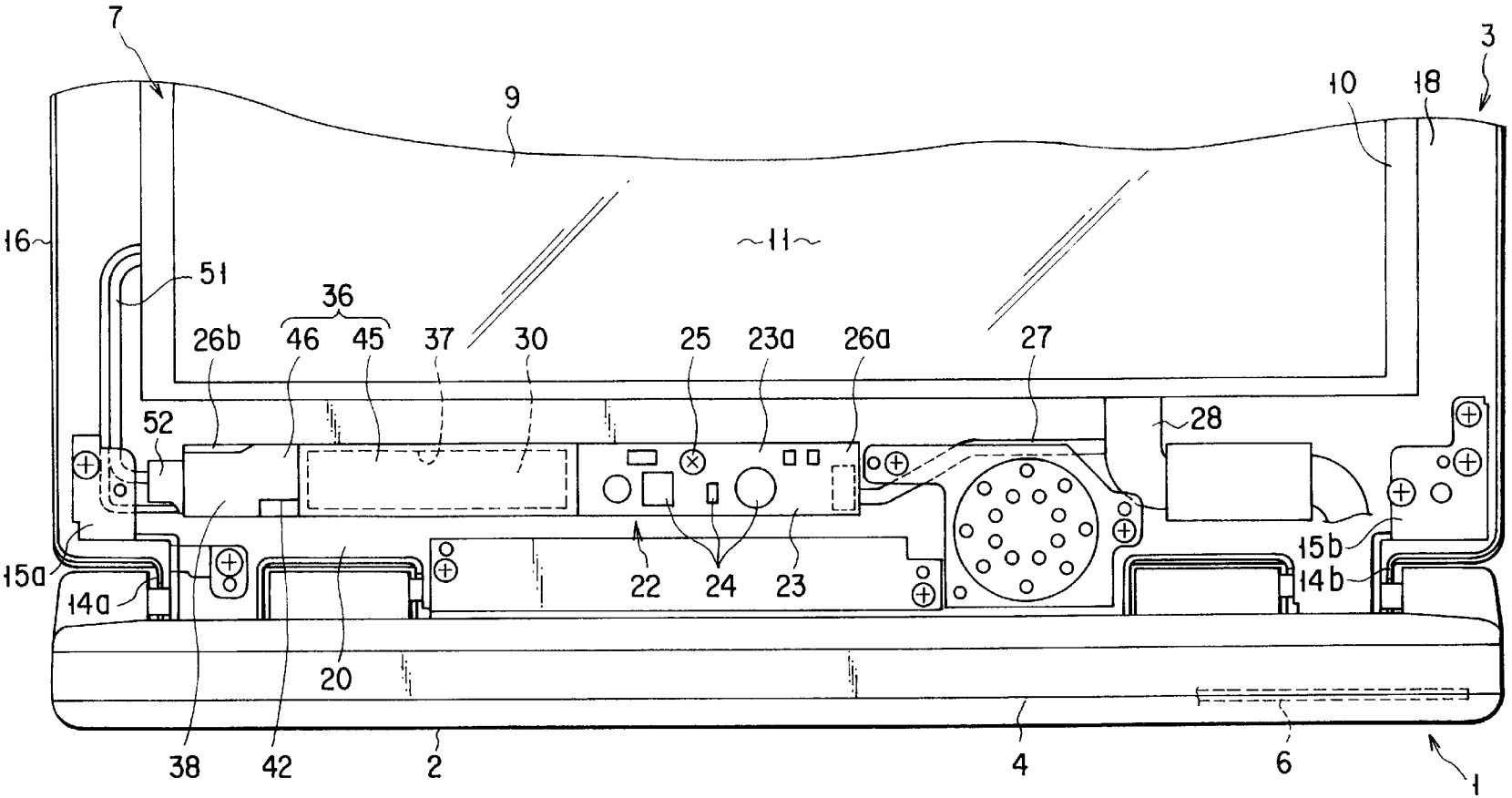
FIG. 2 is a front view of the portable computer, showing the liquid crystal display and FL inverter which are incorporated in the display cover of the display unit of the computer.

FIGS. 1 and 2 shows the portable computer 1, which is a book-type one. The portable computer 1 comprises a main body 2 and a display unit 3 supported by the main body 2. The main body 2 has a housing 4 that is shaped like a flat box. The housing 4 comprises a flat top wall 4*a*. A keyboard 5 is mounted on the top wall 4*a*. The housing 4 contains a system board 6, which is connected to the keyboard 5 by a cable (not shown).

The display unit 3 comprises a liquid crystal display 7 and a flat, box-like display housing 8. The display 7 is an active component, and the housing 8 contains the display 7. As shown in FIG. 2, the display 7 comprises a flat display panel 9 and a frame 10. The frame 10 holds the display panel 9. The display panel 9 has a display screen 11 for displaying characters and images. The display screen 11 is large enough display information that is easy to perceive visually. The display housing 8 has a rectangular opening 12 in its front. The opening 12 is as large as the display screen 11. The display screen 11 is exposed outside the display housing 8, through the opening 12.

The display housing 8 has a pair of legs 14*a* and 14*b*. The legs 14*a* and 14*b* protrude downwards from the lower edge of the housing 8. The legs 14*a* and 14*b* are spaced apart in the widthwise direction of the display housing 8. As shown in FIG. 2, the legs 14*a* and 14*b* are coupled to the housing 4 of the main body 2, by means of hinge devices 15*a* and 15*b*, respectively. The display unit 3 can thereby be rotated between a closed position and an opened position. In the closed position, the display unit 3 covers the keyboard 5. In the opened position, the display unit 3 stands upright, exposing the keyboard 5.

The display housing 8 comprises a display cover 16 and a display mask 17 coupled to the cover 16. The display cover 16 has a flat bottom wall 18. The liquid crystal display 7 is secured to the center part of the bottom wall 18. The display mask 17 has a front wall 19 that has the above-mentioned opening 12. The bottom wall 18 of the display cover 16 and the front wall 19 of the display mask 17 cooperate, providing a receptacle 20 in the display housing 8. As shown in FIG. 2 the receptacle 20 is located in the lower part of the liquid crystal display 7 standing upright while the display unit 3 remains in the opened position.

An FL inverter 22, or a circuit module, is held in the receptacle 20. The FL inverter 22 is designed to drive the back light (not shown) incorporated in the liquid crystal display 7. The inverter 22 is an elongate component; it extends in the widthwise direction of the display housing 8. The inverter 22 is held in the receptacle 20, lying in horizontal position and extending along the lower side of the frame 10.

The FL inverter 22 comprises a circuit board 23 and a number of circuit components 24. The circuit board 23 has a mount surface 23*a*, on which the circuit components 24 are provided. The circuit board 23 is rectangular, extending in the widthwise direction of the display housing 8. The board 23 is fastened to the bottom wall 18 of the display cover 16 by means of screws 25. The board 23 has two ends 26*a* and 26*b*, which are spaced apart in the lengthwise direction of the circuit board 23. A cable 27 is connected to the first end 26*a*. A cable 28 is connected to the drive circuit section (not shown) of the liquid crystal display 7. The cables 27 and 28 are put together, forming a bundle. Both cables 27 and 28 are guided into the housing 4 and electrically connected to the system board 6.

Figure 4:
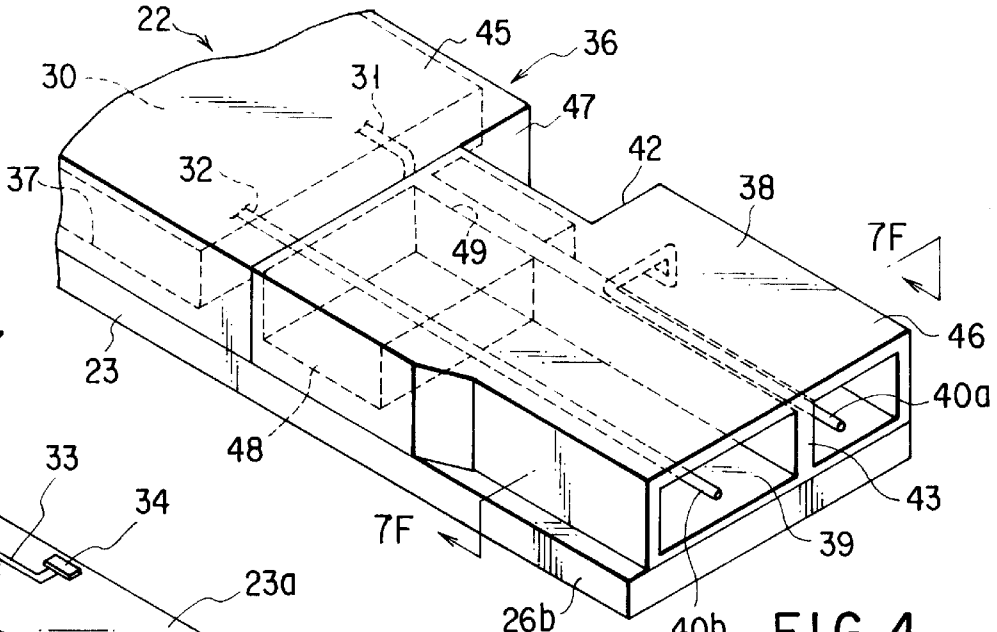
FIG. 4 is a perspective view of the FL inverter, showing the connector section of the cover of the FL inverter.
Figure 5:
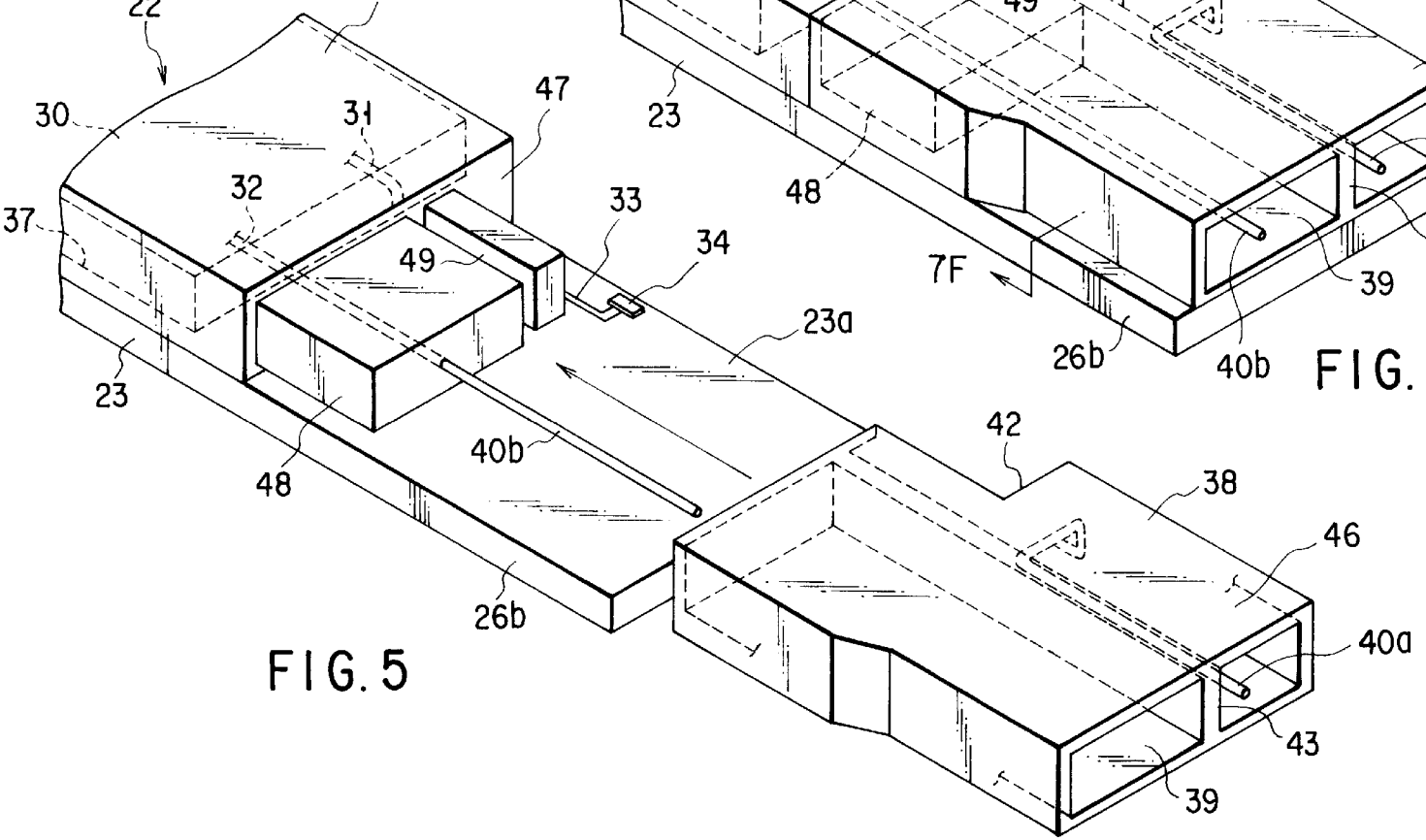
FIG. 5 is a perspective view of the FL inverter, illustrating the first and second sections of the cover, which are separated from each other.
Figure 6:
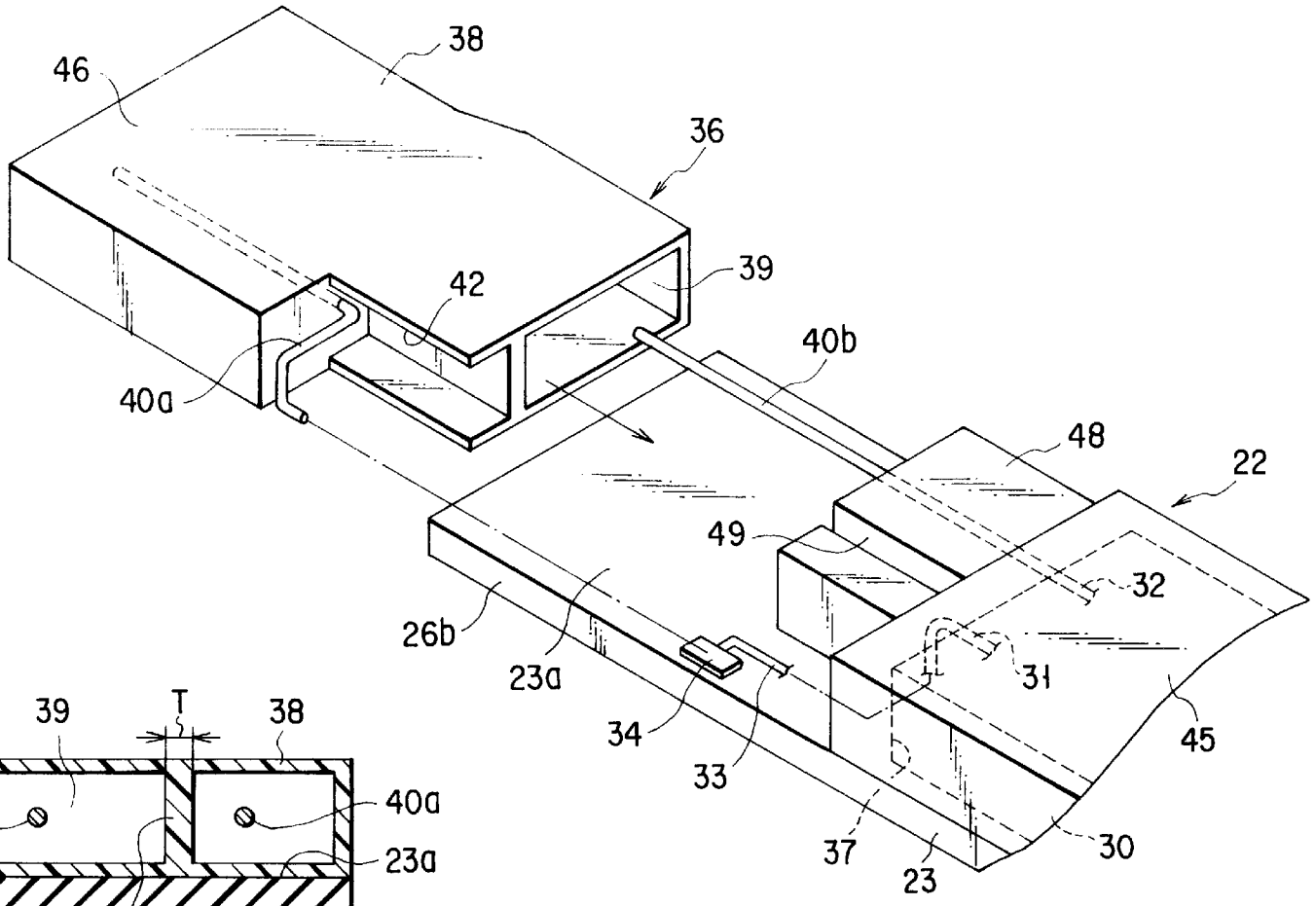
FIG. 6 is a another perspective view showing the first and second sections of the cover, which are separated from each other.

Among the circuit components 24 is a transformer 30, which is located near the second end 26*b* of the circuit board 23. The transformer 30 has an input terminal (not shown). The input terminal is soldered to the mount surface 23*a* of the circuit board 23, whereby the transformer 30 is held on the mount surface 23*a*. As shown in FIGS. 4 to 6, the transformer 30 has two output terminals 31 and 32. The first output terminal 31 and second output terminal 32 are provided to output a reference voltage and a higher voltage, respectively. Both output terminals 31 and 32 are located at one end of the transformer 30 and arranged side by side in the widthwise direction of the circuit board 23.

The first output terminal 31 is led downwards from the end of the transformer 30 and soldered to a wiring pattern 33 provided on the circuit board 23. The wiring pattern 33 extends from one end of the transformer 30 toward the second end 26*b* of the circuit board 23. The distal end of the wiring pattern 33 is electrically connected to a pad 34 provided on the mount surface 23*a*.

A cover 36 covers the transformer 30. The cover 36 is a molding made of a synthetic resin such as PBT (Polyethylene Terephthalate) and is electrically insulating. The cover 36 has a transformer receptacle 37 and a connector section 38 continuous to the receptacle 37. The receptacle 37 has a recess, in which the transformer 30 is tightly fitted. The receptacle 37 completely covers the transformer 30 and the first and second output terminals 31 and 32. The connector section 38 overlaps the second end 26*b* of the circuit board 23. The section 38 is shaped like a box and has an opening 39. First and second connection terminals 40*a* and 40*b*, each shaped like a pin, are arranged in the connector section 38. The connection terminals 40*a* and 40*b* extend parallel in the widthwise direction of the circuit board 23. The terminals 40*a* and 40*b* are spaced from each other and also from the inner surfaces of the connector section 38 and are located above the mount surface 23*a* of the circuit board 23. Hence, the connector section 38 surrounds the connection terminals 40*a* and 40*b* located above the circuit board 23.

The cover 36 has a notch 42 at the junction between the connector section 38 and the transformer receptacle 37. The notch 42 is vertically aligned with the pad 34 provided on the mount surface 23*a* of the circuit board 23. The pad 34 is therefore exposed outside the cover 36, through the notch 42.

As shown in FIG. 6, one end of the first connection terminal 40*a* is led to the notch 42 and soldered to the pad 34. Thus, the first connection terminal 40*a* is electrically connected to the first output terminal 31 of the transformer 30 by the pad 34 and the wiring pattern 33.

The second connection terminal 40*b* passes through the connector section 38 and is guided into the transformer receptacle 37. One end of the terminal 40*b* is electrically connected to the second output terminal 32 in the transformer receptacle 37.

Figure 7:
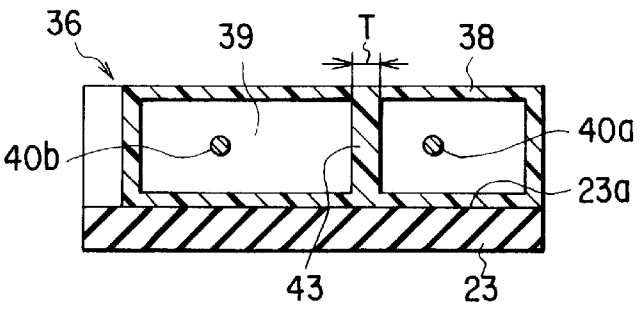
FIG. 7 is a sectional view taken along line 7F—7F in FIG. 4.

As shown in FIGS. 4 and 7, the connector section 38 has a partition 43 in its interior. The partition 43 extends straight in the lengthwise direction of the circuit board 23 and between the connection terminals 40*a* and 40*b*, concealing the connection terminals 40*a* and 40*b* from each other in the connector section 38. If the cover 36 is made of PBT, the partition 43 has a thickness T of at least 0.4 mm for reliable partition between the first connection terminal 40*a* and the second connection terminal 40*b*.

As shown in FIGS. 4 to 6, the cover 36 consists of two cover sections 45 and 46. The first cover section 45 has the transformer receptacle 37, whereas the second cover section 46 has the connector section 38 and the notch 42. The first cover section 45 has an abutting surface 47, on which the second cover section 48 abuts. On the abutting surface 47 a projection 48 is formed integral with the first cover section 45. The second connection terminal 40*b* passes through the projection 48. The projection 48 has a slit 49, which is horizontally aligned with the partition 43. Hence, the first cover section 45 and second cover section 46 are coupled together by fitting the projection 48 into the connector section 38. The transformer 30 and the first and second connection terminals 40*a* and 40*b* are thereby covered, except the junction between the pad 34 and the first connection terminal 40*a*.

Figure 3:
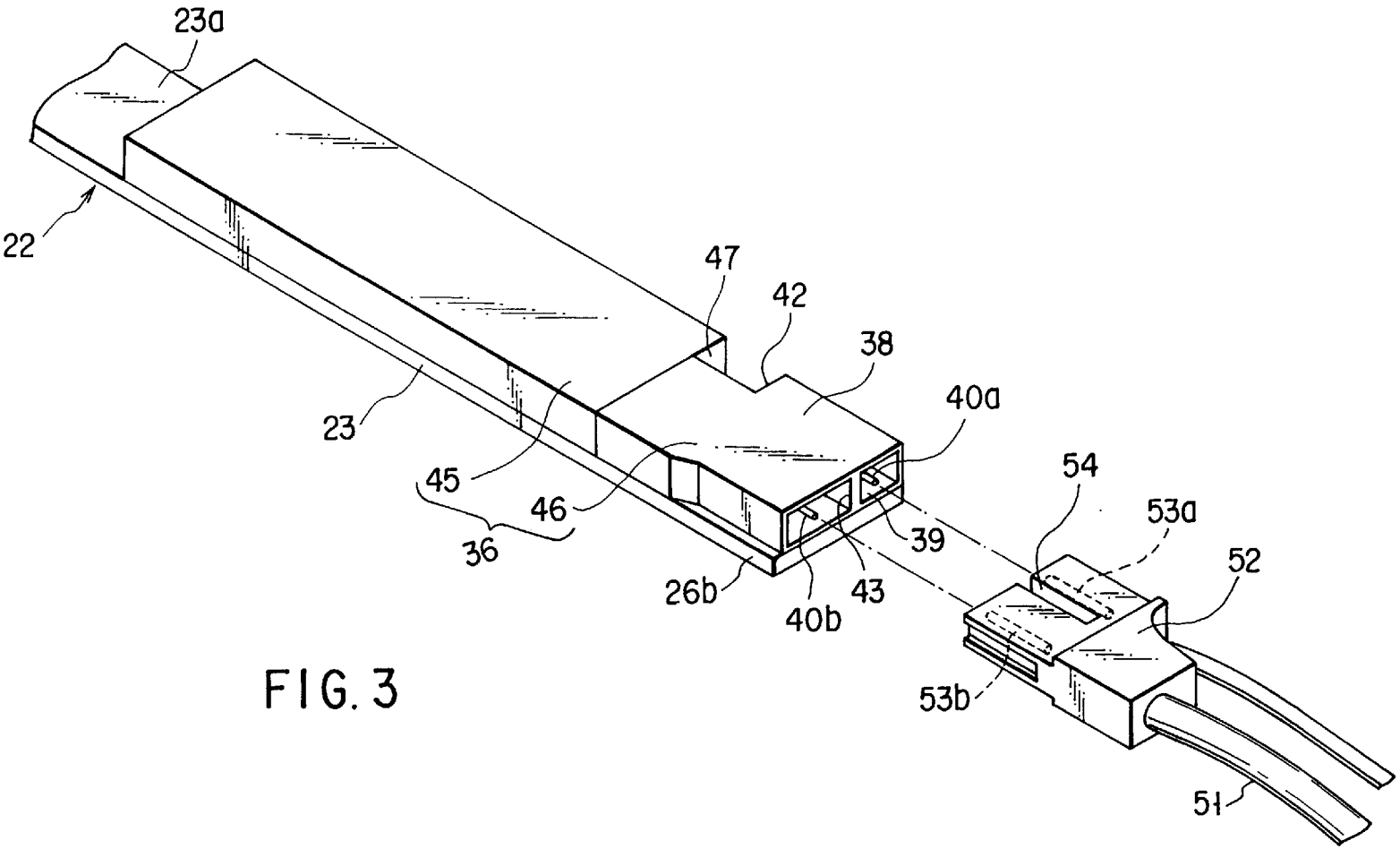
FIG. 3 is a perspective view of the FL inverter incorporated in the display cover.

As shown in FIG. 3, the FL inverter 22 is electrically connected to the back light of the liquid crystal display 7, by means of a cable 51. The cable 51 has a relay connector 52. The relay connector 52 is removably fitted in the connector section 38. The relay connector 52 has a pair of terminal holes 53*a* and 53*b* and a slit 54. The holes 53*a* and 53*b* serve as the third connection terminal and the fourth connection terminal, respectively. The slit 54 holds the partition 43. That is, the relay connector 52 has been fitted into the connector section 38, inserting the first and second connection terminals 40*a* and 40*b* into the terminal holes 53*a* and 53*b*, respectively. Thus, the FL inverter 22 is electrically connected to the back light of the liquid crystal display 7.

In the FL inverter 22, the cover 36 covering the transformer 30 has the connector section 38 that surrounds the first and second connection terminals 40*a* and 40*b*, and the partition 43 is provided in the connector section 38. The partition 43 separates the first connection terminal 40*a* applied with the reference voltage and the second connection terminal 40*b* applied with the high voltage, from each other. Further, both connection terminals 40*a* and 40*b* are located above the mount surface 23*a* of the circuit board 23. Still further, the cover 36 completely covers the second connection terminal 40*b* applied with the high voltage, including the junction between it and the second output terminal 32. These structural features ensure the reliable electrical insulation between the first and second connection terminals 40*a* and 40*b*. The connection terminals 40 and 40*b* can therefore be arranged closer than in the conventional FL inverter. The cover 36, including the connector section 38, and the circuit board 23 can therefore be narrower than in the conventional FL inverter. The FL inverter 22 can be made slender and compact, occupying but a small space in the display housing 8. This helps to reduce the size of the display housing 8 as is desired.

There is no need to cut a slit in the circuit board 23, at a part that lies between the first connection terminal 40*a* and the second connection terminal 40*b*. The circuit board 23 is therefore strong enough not to be bent or deformed. Hence, the electrical connection between the transformer 30 and the connection terminals 40*a* and 40*b* is sufficiently reliable.

Moreover, the cover 36 completely covers the transformer 30 and the connection terminals 40*a* and 40*b*, because it has a connector section 38. An insulator is not required to cover the solder junction between the second output terminal 32 and the second connection terminal 40*b* applied with the high voltage. The FL inverter 22 therefore comprises less components and can be assembled more easily than the conventional FL inverter which must have such an insulator.

Figures 8, 9:
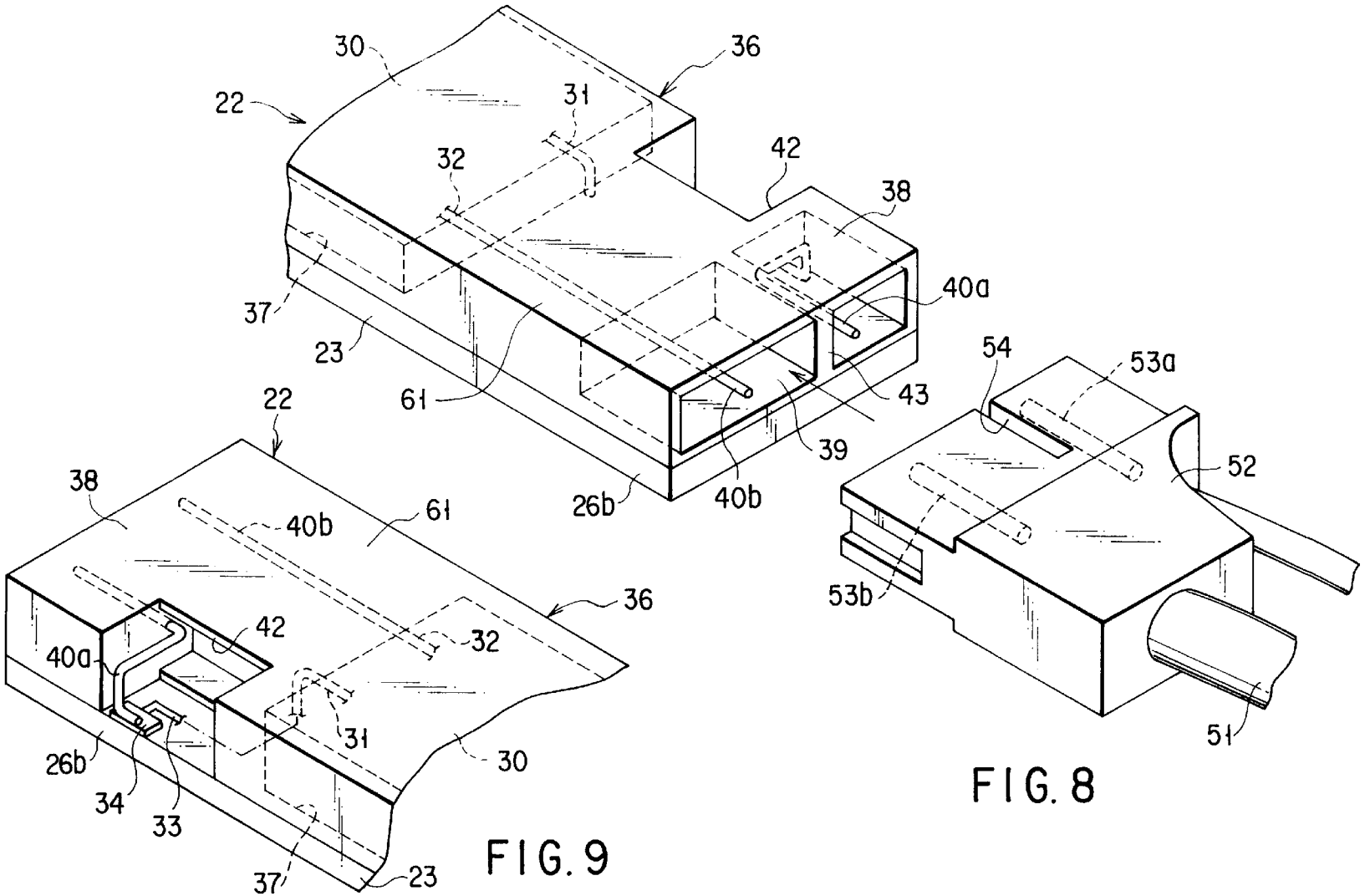
FIG. 8 is a perspective view of the FL inverter according to the second embodiment of the invention, illustrating the connector section of the cover of the FL inverter.
FIG. 9 is a perspective view of the FL inverter according to the second embodiment, showing the connection of the first connection terminal and the first output terminal of the FL inverter.

The present invention is not limited to the first embodiment described above. FIGS. 8 and 9 show the second embodiment of the invention.

The second embodiment is different from the first embodiment, in that the transformer receptacle 37 and connector section 38 of the cover 36 are formed integral. In the second embodiment, the cover 36 has an intermediate section 61 which is a solid block. The intermediate section 61 is located between the receptacle 37 and the section 38 and has a notch 42 in one side. The second connection terminal 40*b* extends from the connector section 38 to the transformer receptacle 37, passing through the intermediate section 61.

Figure 10:
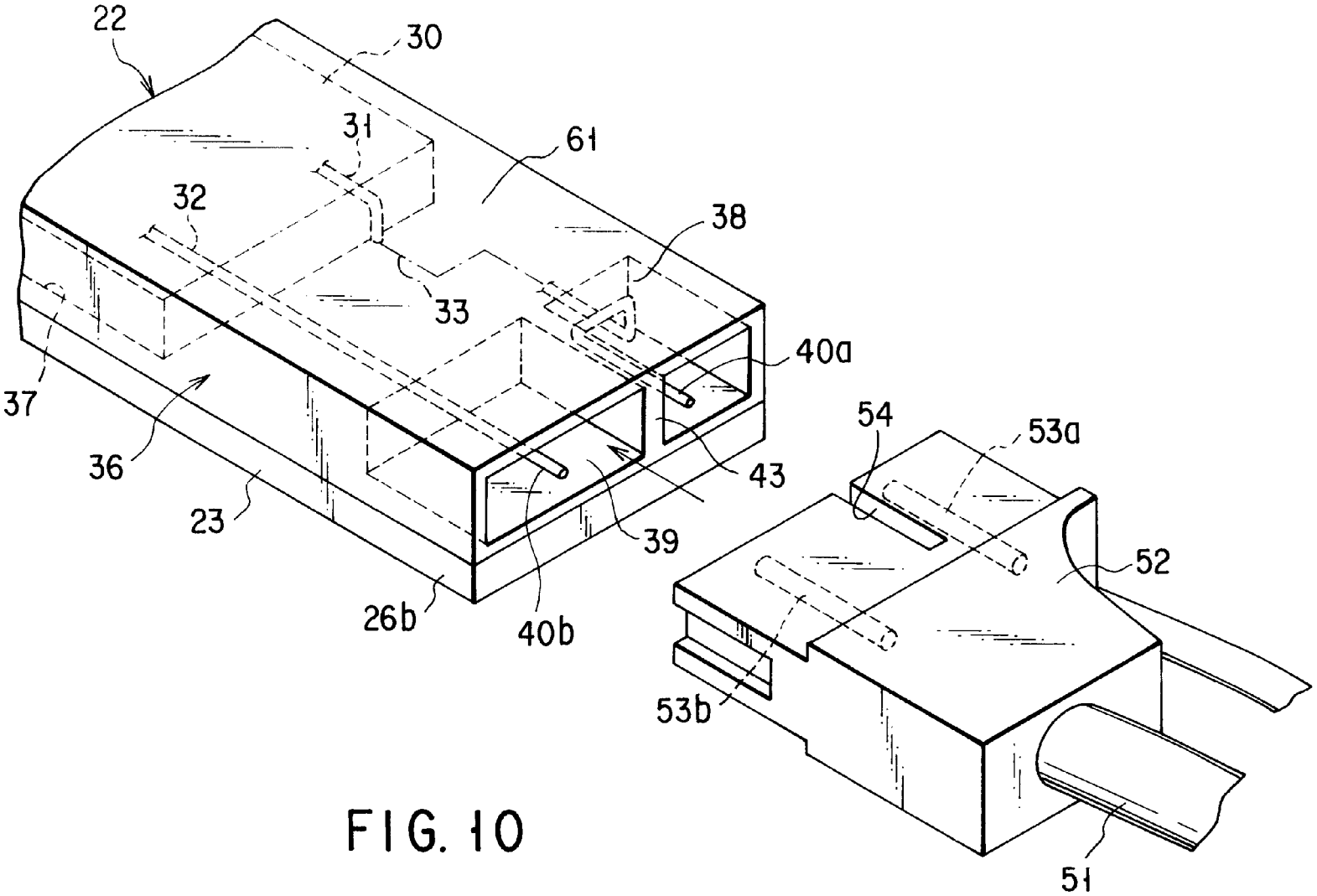
FIG. 10 is a perspective view of the FL inverter according to the third embodiment of the invention, illustrating the connector section of the cover of the FL inverter.

FIG. 10 illustrates the third embodiment of the present invention. The third embodiment is identical to the second embodiment, except that the intermediate section 61 covers the solder junction among the wiring pattern 33, pad 34 and first connection terminal 40*a*. Thus, the cover 36 covers the first output terminal 31, the junction between the pad 34 and first connection terminal 40*a*, and the junction between the second output terminal 32 and second connection terminal 40*b*.

Figure 11:
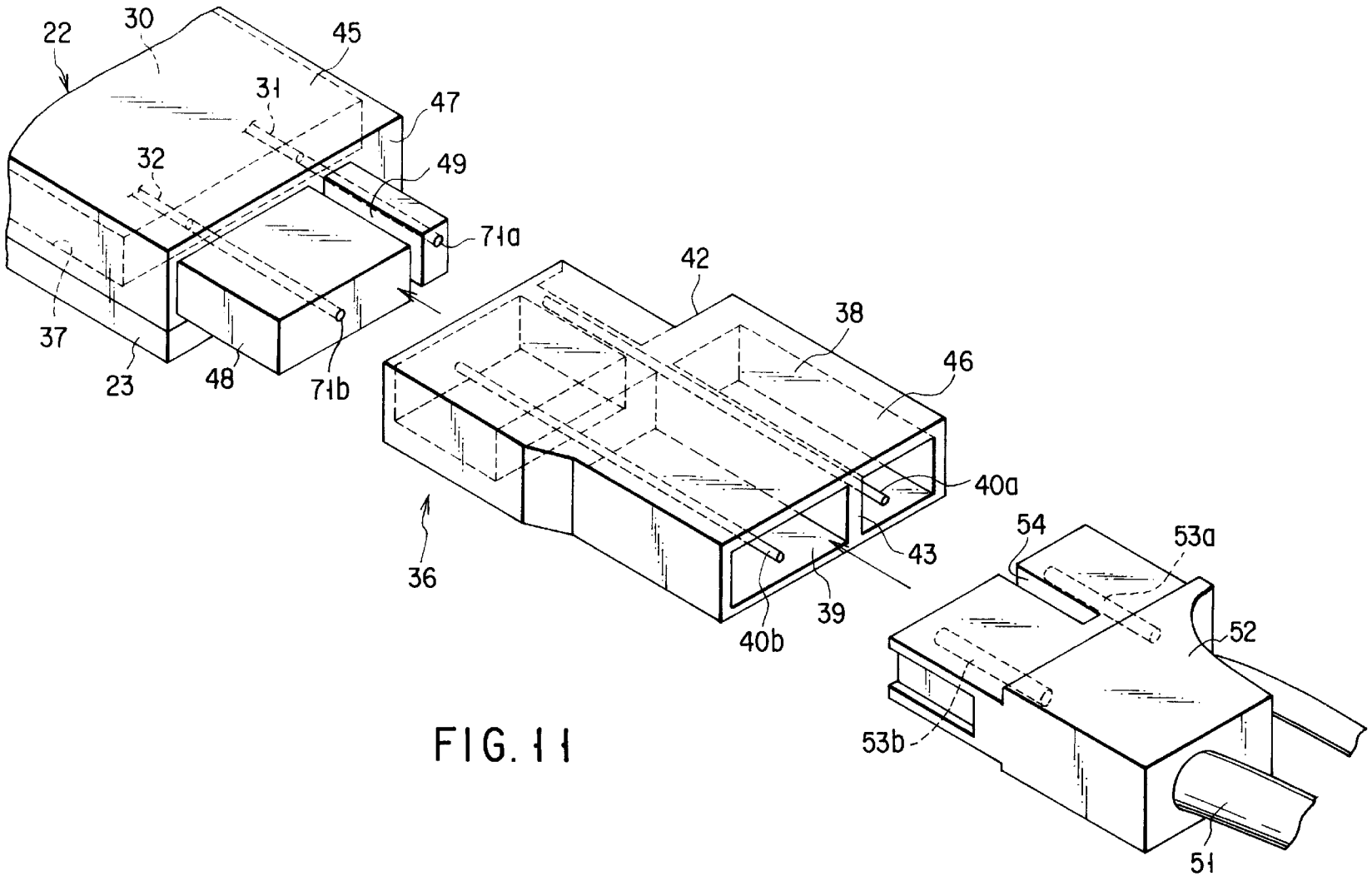
FIG. 11 is a perspective view of the FL inverter according to the fourth embodiment of the invention, showing the connector section of the cover of the FL inverter.

FIG. 11 depicts the fourth embodiment of this invention. The fourth embodiment is different in the structure of electrically connecting the connection terminals 40*a* and 40*b* to the transformer 30. In all other respects the fourth embodiment is identical to the first embodiment. The components identical to those of the first embodiment are denoted at the same reference numerals and will not be described in detail.

As shown in FIG. 11, the projection 48 of the first cover section 45 has a pair of terminal holes 71*a* and 71*b*. The holes 71*a* and 71*b* have been made by embedding two electrically conductive pipes in the projection 48. The holes 71*a* and 71*b* extend parallel, spaced apart in the width direction of the circuit board 23. The conductive pipes are electrically connected to the first and second output terminals 31 and 32, respectively. The projection 48 of the first cover section 45 is fitted in the second cover section 46, and the first and second connection terminals 40*a* and 40*b* are inserted in the terminal holes 71*a* and 71*b*, respectively. Thus, the connection terminals 40*a* and 40*b* are electrically connected to the transformer 30.

In the present invention, the material of the cover 36 is not limited to PBT. The cover 36 may be made of any other synthetic resins or ceramic material.

The circuit module according to this invention finds its use not only in a display unit supported on the main body of a computer. Rather, the circuit module can also be used to drive the back light of a liquid crystal display connected to a computer, not incorporated therein.

It should be noted that the circuit module according to the present invention is not limited to an FL inverter for driving the back light of a liquid crystal display.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A circuit module comprising:

a circuit board;

a high-voltage element electrically connected to the circuit board and having a first output terminal for outputting a reference voltage and a second output terminal for outputting a voltage higher than the reference voltage; and an electrically insulating cover covering the high-voltage element and including a connector section having:

a first connection terminal electrically connected to the first output terminal;

a second connection terminal electrically connected to the second output terminal and spaced apart from the first connection terminal; and a partition provided between the first connection terminal and the second connection terminal extending to a top surface and a bottom surface of the connector section, the partition extending in a lengthwise direction of the connection terminals and concealing the connection terminals from each other.

2. A circuit module according to claim 1, wherein the circuit board has a mount surface, and the high-voltage element and the connector section are arranged side by side on the mount surface.

3. A circuit module according to claim 2, wherein the first and second connection terminals are spaced apart from the mount surface of the circuit board.

4. A circuit module according to claim 1, wherein the cover is composed of a first cover section covering the high-voltage element and a second cover section constituting the connector section.

5. A circuit module according to claim 1, further comprising a relay connector removably connected to the connector section and having a third connection terminal electrically connected to the first connection terminal, a fourth connection terminal electrically connected to the second connection terminal and a slit located between the third and fourth connection terminals and holding the partition.

6. A circuit module comprising:

a circuit board;

a high-voltage element electrically connected to the circuit board and having a first output terminal for outputting a reference voltage and a second output terminal for outputting a voltage higher than the reference voltage; and an electrically insulating cover covering the high-voltage element and including a connector section having a first connection terminal electrically connected to the first output terminal and a second connection terminal electrically connected to the second output terminal, wherein said cover is comprised of a first cover section and a second cover section separated from the first cover section, said first cover section covers the high-voltage element and at least that part of the connector section which connects the second connection terminal and the second output terminal, said second cover section covers at least the second connection terminal of the connector section, and said first and second cover sections are coupled together on the circuit board.

7. An electronic apparatus comprising:

a housing; and a circuit module provided in the housing and comprising:

a circuit board supported in the housing;

a high-voltage element mounted on the circuit board and having a first output terminal for outputting a reference voltage and a second output terminal for outputting a voltage higher than the reference voltage; and an electrically insulating cover covering the high-voltage element and including a connector section having:

a first connection terminal electrically connected to the first output terminal;

a second connection terminal electrically connected to the second output terminal and spaced apart from the first connection terminal; and a partition provided between the first connection terminal and the second connection terminal extending to a top surface and a bottom surface of the connector section, the partition extending in a lengthwise direction of the connection terminals and concealing the connection terminals from each other.

8. An electronic apparatus according to claim 7, further comprising:

an active component provided in the housing, having a relay connector electrically connected to the connector section of the circuit module, and arranged together with the circuit module in the housing.

9. An electronic apparatus according to claim 7, wherein:

the connector section has an opening and an end portion, the opening exposing the first and second connection terminals, the end portion being located opposite to the opening; and the partition extends from the opening to the end portion.

10. An electronic apparatus comprising:

a housing; and a circuit module provided in the housing and comprising:

a circuit board supported in the housing;

a high-voltage element electrically connected to the circuit board and having a first output terminal for outputting a reference voltage and a second output terminal for outputting a voltage higher than the reference voltage; and an electrically insulating cover covering the high-voltage element and including a connector section having a first connection terminal electrically connected to the first output terminal and a second connection terminal electrically connected to the second output terminal, wherein said cover is comprised of a first cover section and a second cover section separated from the first cover section, said first cover section covers the high-voltage element and at least that part of the connector section which connects the second connection terminal and the second output terminal, said second cover section covers at least the second connection terminal of the connector section, and said first and second cover sections are coupled together on the circuit board.

11. An electrically insulating cover covering a high-voltage element, having a first output terminal and a second output terminal, said cover comprising:

a first connection terminal electrically connected to the first output terminal;

a second connection terminal electrically connected to the second output terminal and spaced apart from the first connection terminal; and a partition provided between the first connection terminal and the second connection terminal extending to a top surface and a bottom surface of the cover, the partition extending in a lengthwise direction of the connection terminals and concealing the connection terminals from each other.

12. An electrically insulating cover according to claim 11, further comprising a terminal receptacle in which the first and second connection terminals are arranged, the terminal receptacle being divided by the partition into a first receptacle and a second receptacle such that the first connection terminal is located in the first receptacle and the second connection terminal is located in the second receptacle and the first and second receptacles are independent receptacles provided with the partition in between.

13. An electrically insulating cover according to claim 11, the electrically insulating cover further comprising:

an opening exposing the first and second connection terminals; and an end portion located opposite to the opening;

wherein the partition extends from the opening to the end portion.

14. A circuit module comprising:

a circuit board;

high-voltage element electrically connected to the circuit board and having a first output terminal for outputting a reference voltage and a second output terminal for outputting a voltage higher than the reference voltage; and an electrically insulating cover covering the high-voltage element and including a connector section having:

a terminal receptacle;

a wall dividing the terminal receptacle into a first receptacle and a second receptacle extending to a top surface and a bottom surface of the terminal receptacle, the wall extending in a lengthwise direction of the terminal receptacle such that the first and second receptacles are independent receptacles provided with the wall in between;

a first connection terminal electrically connected to the first output terminal and arranged in the first receptacle; and a second connection terminal electrically connected to the second output terminal and arranged in the second receptacle.

15. A circuit module according to claim 14, wherein:

the connector section has an opening and an end portion;

the opening exposing the first and second connection terminals, the end portion being located opposite to the opening; and the wall extends from the opening to the end portion.

16. A circuit module comprising:

a circuit board;

a high-voltage element electrically connected to the circuit board and having a first output terminal for outputting a reference voltage and a second output terminal for outputting a voltage higher than the reference voltage;

a first connection terminal electrically connected to the first output terminal;

a second connection terminal electrically connected to the second output terminal;

a first junction between the first connection terminal and the first output terminal;

a second junction between the second connection terminal and the second output terminal; and an electrically insulating cover covering the high-voltage element, the first connection terminal, second connection terminal and the second junction, wherein said first junction is arranged outside of the cover.

17. A circuit module according to claim 16, wherein the electrically insulating cover includes a partition which is provided between the first and second connection terminals, which extends between positions corresponding to a top end and a bottom end of each of the first and second connection terminals, and which isolates the first and second connection terminals from each other.

18. A circuit module according to claim 17, wherein:

the electrically insulating cover has an opening and an end portion, the opening exposing the first and second connection terminals, the end portion being located opposite to the opening; and the partition extends from the opening to the end portion.

19. A circuit module comprising:

a circuit board having a mount surface and a wiring pattern provided on the mount surface;

a high-voltage element arranged on the mount surface, electrically connected to the circuit board and having a first output terminal for outputting a reference voltage and a second output terminal for outputting a voltage higher than the reference voltage; and an electrically insulating cover covering the high-voltage element and including a connector section arranged adjacent to the high-voltage element on the mount surface, the connector section having:

a first connection terminal electrically connected to the first output terminal through the wiring pattern;

a second connection terminal electrically connected to the second output terminal and spaced apart from the first connection terminal; and a partition provided between the first connection terminal and the second connection terminal and isolating the connection terminals from each other, wherein said cover has a notch exposing a junction between the first connection terminal and the wiring pattern.

20. A circuit module comprising:

a circuit board;

a high-voltage element electrically connected to the circuit board and including a first output terminal for outputting a reference voltage and a second output terminal for outputting a voltage higher than the reference voltage; and an electrically insulating cover covering the high-voltage element and including a connector section comprising:

a first connection terminal electrically connected to the first output terminal;

a second connection terminal electrically connected to the second output terminal and spaced apart from the first connection terminal;

a terminal receptacle in which the first and second terminal are arranged; and a partition provided between the first connection terminal and the second connection terminal, extending to a top surface and a bottom surface of the connector section, the partition extending in a lengthwise direction of the connection terminals, wherein the terminal receptacle is divided by the partition into a first receptacle and a second receptacle such that the first connection terminal is located in the first receptacle and the second connection terminal is located in the second receptacle, and the first and second receptacles are provided independently of each other, with the partition interposed there between.

21. A circuit module comprising:

a circuit board;

a high-voltage element electrically connected to the circuit board and including a first output terminal for outputting a reference voltage and a second output terminal for outputting a voltage higher than the reference voltage; and an electrically insulating cover covering the high-voltage element and including a connector section comprising:

a first connection terminal electrically connected to the first output terminal;

a second connection terminal electrically connected to the second output terminal and spaced apart from the first connection terminal; and partition provided between the first connection terminal and the second connection terminal;

wherein the connector section includes an opening and an end portion; the opening exposing the first and second connection terminals, the end portion being located opposite to the opening, and the partition extends from the end portion to the opening, thereby concealing the connection terminals from each other.

* * * * *

UNITED STATES PATENT AND TRADEMARK OFFICE

CERTIFICATE OF CORRECTION

PATENT NO. : 6,332,783 B1
DATED : December 25, 2001
INVENTOR(S) : Yoshiaki Ukiya et al.

It is certified that error appears in the above-identified patent and that said Letters Patent is hereby corrected as shown below:

Title page,
Item [57], ABSTRACT,
Line 3, “insulting cover” should read -- insulating cover --.

Column 11,
Line 61, “high-voltage element” should read -- a high-voltage element --.

Column 14,
Line 23, “partition provided” should read -- a partition provided --.

Signed and Sealed this

Twenty-sixth Day of November, 2002

*Attest:*

*Attesting Officer*

JAMES E. ROGAN
*Director of the United States Patent and Trademark Office*